US012207775B2

(12) United States Patent
Liang et al.

(10) Patent No.: US 12,207,775 B2
(45) Date of Patent: Jan. 28, 2025

(54) CONTAINER AND CLEANING BASE STATION

(71) Applicant: SHENZHEN SILVER STAR INTELLIGENT GROUP CO., LTD., Shenzhen (CN)

(72) Inventors: Jie Liang, Shenzhen (CN); Linlin Zhou, Shenzhen (CN); Wenbin Yong, Shenzhen (CN)

(73) Assignee: SHENZHEN SILVER STAR INTELLIGENT GROUP CO., LTD., Shenzhen (CN)

( * ) Notice: Subject to any disclaimer, the term of this patent is extended or adjusted under 35 U.S.C. 154(b) by 143 days.

(21) Appl. No.: 17/898,881

(22) Filed: Aug. 30, 2022

(65) Prior Publication Data

US 2023/0148822 A1 May 18, 2023

(30) Foreign Application Priority Data

Nov. 13, 2021 (CN) ..... 202111343656.X

(51) Int. Cl.
*A45C 13/10* (2006.01)
*A47L 11/40* (2006.01)
*B65D 43/02* (2006.01)

(52) U.S. Cl.
CPC ..... *A47L 11/4083* (2013.01); *A45C 13/10* (2013.01); *A47L 11/4016* (2013.01); *A47L 11/4075* (2013.01); *B65D 43/0204* (2013.01); *A47L 2201/02* (2013.01); *B65D 2251/1016* (2013.01)

(58) Field of Classification Search
CPC ..... B65D 43/0204; B65D 2251/1016; B65D 45/18; A45C 13/1053; A45C 13/1084; A45C 13/12; A47L 11/4083
See application file for complete search history.

(56) References Cited

U.S. PATENT DOCUMENTS 4,371,092 A * 2/1983 Teague ..... B65F 1/1615 D8/344
4,782,977 A * 11/1988 Watanabe ..... B65D 55/024 292/307 R
5,577,779 A * 11/1996 Dangel ..... E05C 19/06 220/326
5,676,273 A * 10/1997 Jonkers ..... B65D 43/0225 220/284
6,374,467 B1 * 4/2002 Chen ..... A45C 7/0045 190/102

(Continued)

FOREIGN PATENT DOCUMENTS

GB 2538958 A * 12/2016 ..... A45C 11/20

*Primary Examiner* — Ernesto A Grano
*Assistant Examiner* — Symren K Sanghera
(74) *Attorney, Agent, or Firm* — Samson G. Yu

(57) ABSTRACT

A container includes a tank body and a cover. The tank body defines an opening. The cover detachably covers the opening of the tank body. A sidewall of the tank body defines an accommodating groove. The cover includes a cover body and a plug-in piece extending from the cover body to the tank body. The plug-in piece is capable of extending into the accommodating groove. The container further includes a fixing piece, and the fixing piece detachably covers an opening of the accommodating groove and is capable of being buckled with the plug-in piece accommodated in the accommodating groove.

19 Claims, 12 Drawing Sheets

(56) References Cited

U.S. PATENT DOCUMENTS

| | | | | |
|---|---|---|---|---|
| 11,267,621 | B2 * | 3/2022 | Guerdrum | B65D 81/3813 |
| 2004/0143944 | A1 * | 7/2004 | Huang | B65D 43/22 24/457 |
| 2005/0145529 | A1 * | 7/2005 | Andrews | B65D 85/32 206/521.1 |
| 2006/0162403 | A1 * | 7/2006 | Handel | A45C 13/1084 70/159 |
| 2009/0094809 | A1 * | 4/2009 | Kung | A44B 11/25 24/625 |
| 2017/0137185 | A1 * | 5/2017 | Jones | B65D 21/0233 |
| 2018/0141718 | A1 * | 5/2018 | Ahlström | B65D 81/3813 |
| 2018/0273258 | A1 * | 9/2018 | Luburic | B65D 25/2885 |
| 2019/0092554 | A1 * | 3/2019 | Rogers | B65D 25/08 |
| 2019/0161236 | A1 * | 5/2019 | Knob | B65D 43/0204 |
| 2019/0281955 | A1 * | 9/2019 | Wong | A45C 13/1084 |
| 2020/0324943 | A1 * | 10/2020 | Mattila | E05B 17/0025 |
| 2022/0135294 | A1 * | 5/2022 | Peng | B65D 47/0871 220/203.01 |
| 2022/0289440 | A1 * | 9/2022 | Vera | B65D 43/021 |
| 2023/0380559 | A1 * | 11/2023 | Castillo | A45C 13/02 |
| 2024/0034520 | A1 * | 2/2024 | Lopez Uran | E05C 19/06 |

* cited by examiner

CONTAINER AND CLEANING BASE STATION

CROSS-REFERENCE TO RELATED APPLICATIONS

The present disclosure claims priority of Chinese Patent Application No. 202111343656.X, filed on Nov. 13, 2021, titled "container and cleaning base station", the contents of which are incorporated herein by reference.

TECHNICAL FIELD

The present disclosure relates to the technical field of cleaning equipments, and in particular, relates to a container and a cleaning base station.

BACKGROUND

A cleaning robot currently available in the market is usually used in cooperation with a cleaning base station. After the cleaning robot enters a preset position of the cleaning base station, the cleaning base station can clean the cleaning piece of the cleaning robot. The cleaning base station generally includes at least one of a floor mopping base station and a floor washing base station, wherein the floor mopping base station or the floor washing base station is equipped with two water storage tanks, one of the two water storage tanks is used to store clean water, the other is used to store sewage, and each of the water storage tanks is covered with a cover.

In the related art, the cover is buckled in a buckling hole of the water storage tank, and the connection between the cover and the water storage tank is unstable. Therefore, when the water storage tank is hit by an object, the cover will easily fall off from the opening of the water storage tank, and thus the liquid in the water storage tank will easily spill out of the water storage tank and stain the floor.

SUMMARY

An embodiment of the present disclosure provides a container for a cleaning base station. The container includes a tank body and a cover. The tank body defines an opening. The cover detachably covers the opening of the tank body. A sidewall of the tank body defines an accommodating groove. The cover includes a cover body and a plug-in piece extending from the cover body to the tank body. The plug-in piece is capable of extending into the accommodating groove. The container further includes a fixing piece, and the fixing piece detachably covers an opening of the accommodating groove and is capable of being buckled with the plug-in piece accommodated in the accommodating groove.

Another embodiment of the present disclosure provides a cleaning base station. The cleaning base station includes at least two of the above-mentioned containers.

BRIEF DESCRIPTION OF THE DRAWINGS

In order to explain technical solutions in embodiments of the present disclosure more clearly, attached drawings required in the description of the embodiments or the prior art will be briefly introduced below. Obviously, the attached drawings in the following description are only some embodiments of the present disclosure. For those of ordinary skill in the art, other drawings can be obtained according to these attached drawings without creative labor.

DETAILED DESCRIPTION

In order to make technical problems, technical solutions and beneficial effects to be solved in the present disclosure clearer, the present disclosure will be further explained in detail below with reference to attached drawings and embodiments. It shall be appreciated that the specific embodiments described here are only used to explain the present disclosure and are not used to limit the present disclosure.

It shall be noted that when an element is said to be "fixed" or "positioned" on another element, it may be directly or indirectly located on the other element. When an element is said to be "connected" to another element, it may be directly or indirectly connected to another element.

It shall be appreciated that, orientations or position relationships indicated by terms such as "length", "width", "upper", "lower", "front", "back", "left", "right", "vertical", "horizontal", "top", "bottom", "inside" and "outside" or the like are orientations or position relationships shown based on the attached drawings, and these terms are only used to facilitate the description of the present disclosure and simplify the description, and do not indicate or imply that the device or element described must have a specific orientation, must be constructed and operated in a specific orientation, and thus these terms should not be understood as limitation to the present disclosure.

In addition, terms "first" and "second" are only used for descriptive purposes and should not be understood as indicating or implying relative importance or implicitly indicating the number of indicated technical features. Thus, features defined with "first" and "second" may explicitly or implicitly include one or more of the features. In the description of the present disclosure, "a plurality of" means two or more than two, unless otherwise specifically defined.

Figure 1:
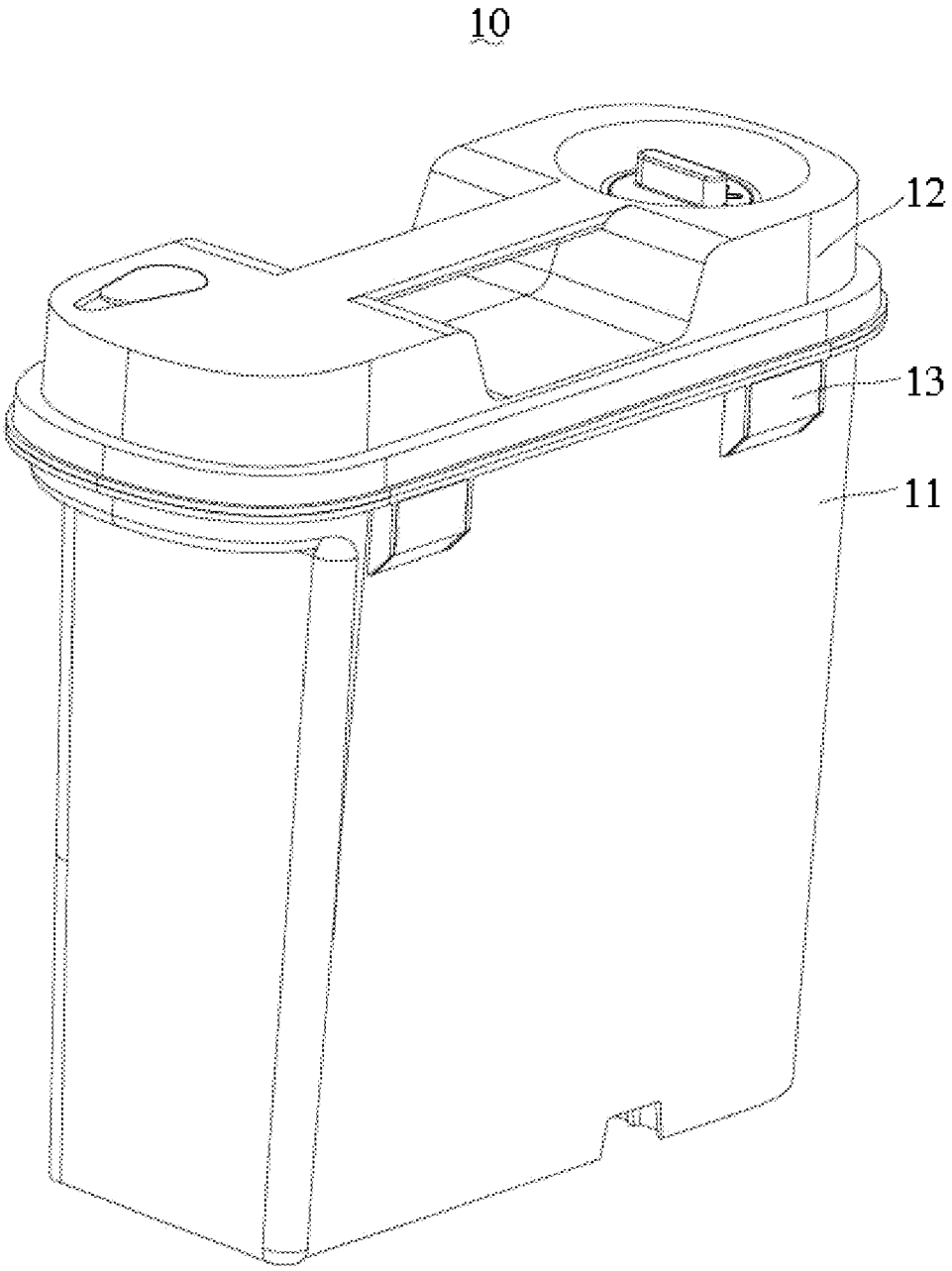
FIG. 1 is a perspective schematic view of a container according to an embodiment of the present disclosure.

Referring to FIG. 1, a container 10 according to an embodiment of the present disclosure will now be described. The container 10 is mainly suitable for a cleaning base station, of course, it may also be used in other equipments, and it is not limited herein.

Figure 2:
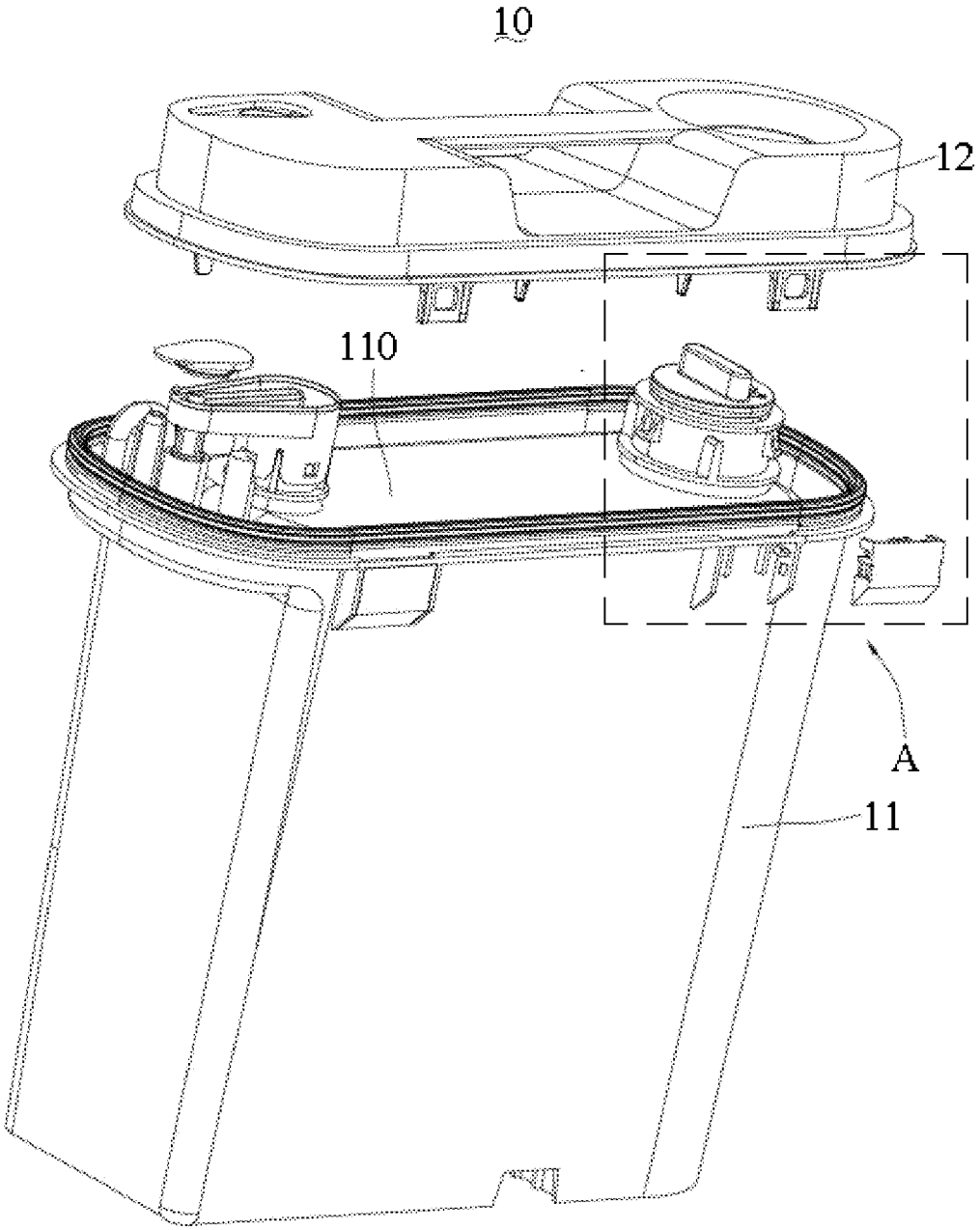
FIG. 2 is a first exploded schematic view of the container of FIG. 1.

Specifically, referring to FIG. 2, the container 10 includes a tank body 11 and a cover 12, the tank body 11 defines an accommodating cavity for accommodating liquid, one side of the accommodating cavity is provided with an opening 110, and the cover 12 detachably covers the opening 110 of the tank body 11.

Figure 3:
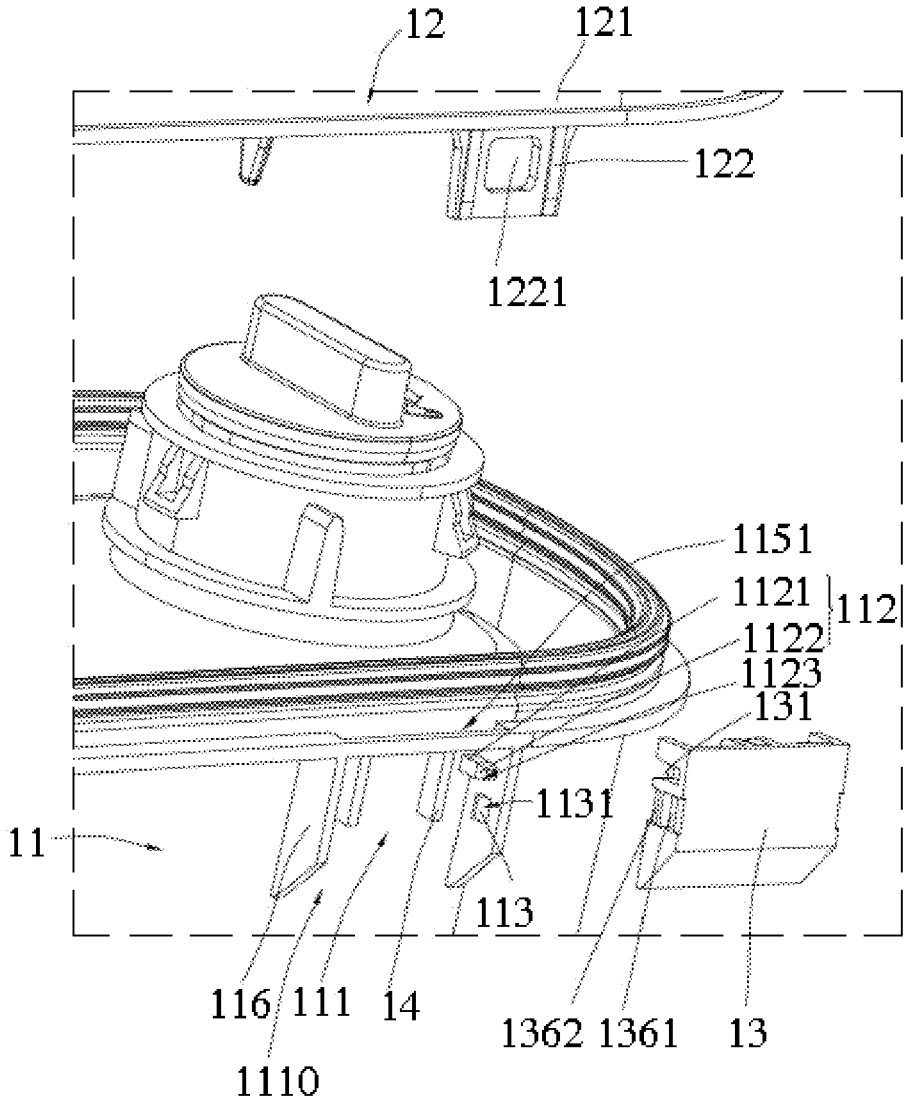
FIG. 3 is a partial enlarged schematic view of part A in FIG. 2.
Figure 4:
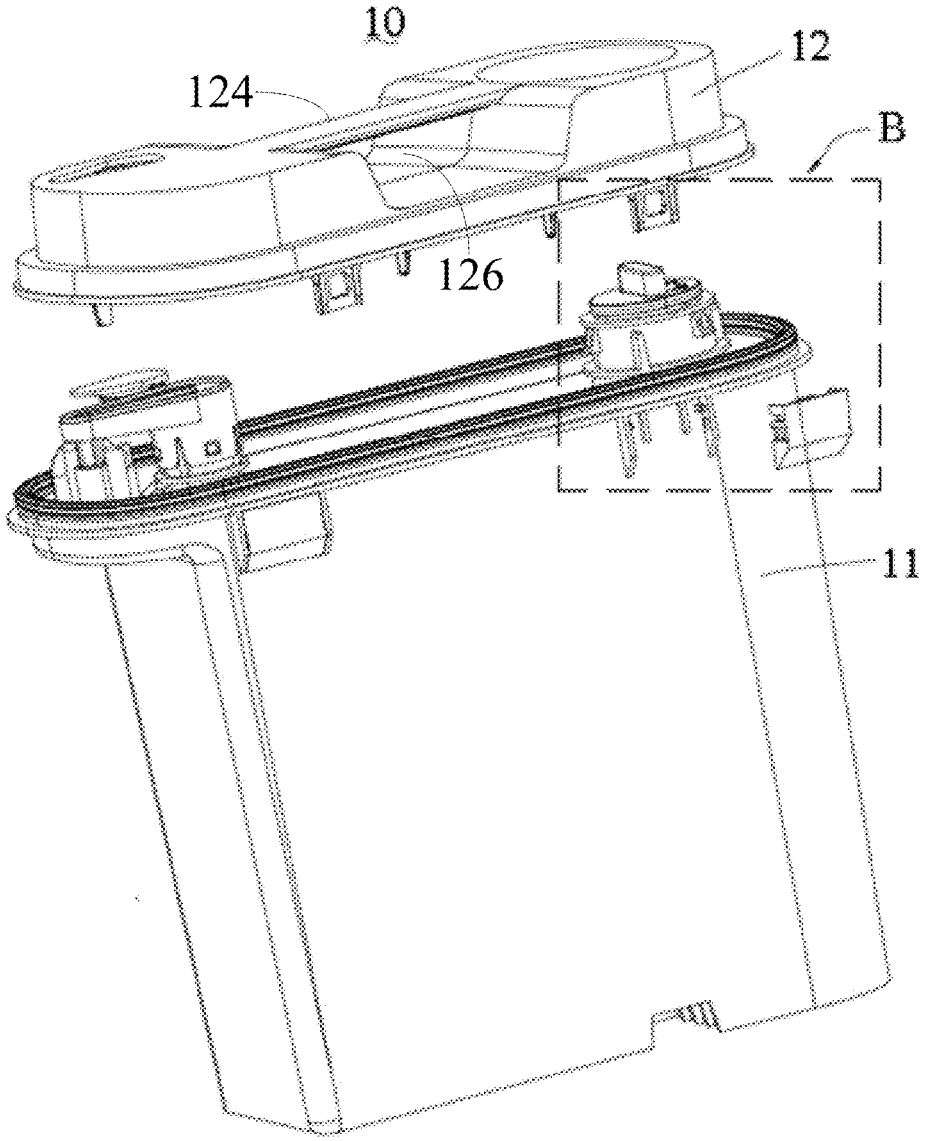
FIG. 4 is a second exploded schematic view of the container of FIG. 1.
Figure 5:
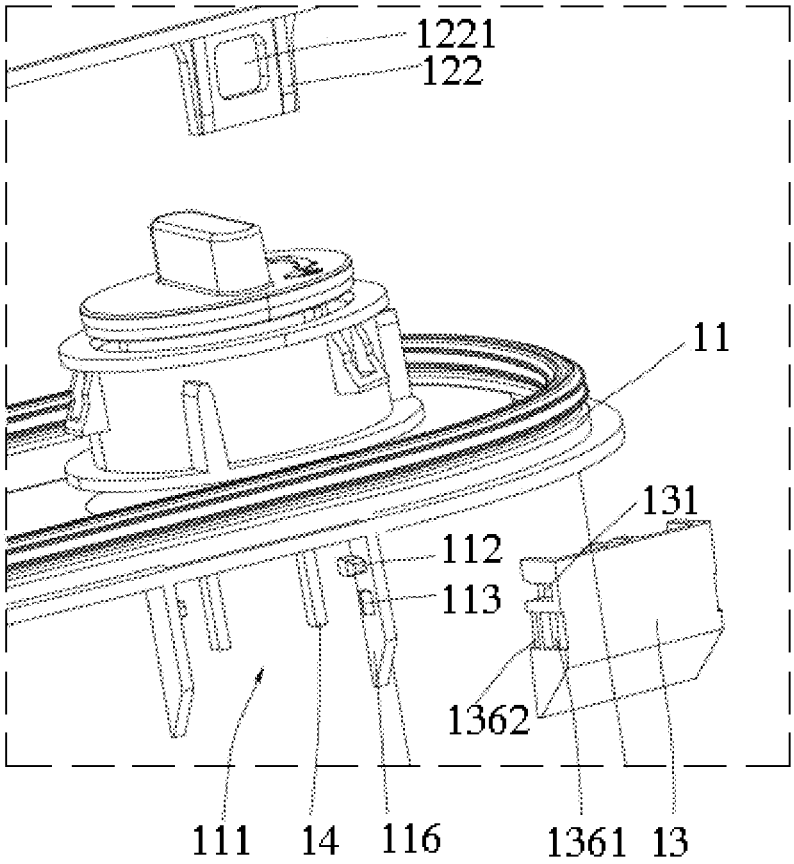
FIG. 5 is a partial enlarged schematic view of part B in FIG. 4.

Further, referring to FIG. 3 to FIG. 5, the sidewall of the tank body 11 defines an accommodating groove 111, the cover 12 includes a cover body 121 and a plug-in piece 122 extending from one side of the cover body 121 towards the tank body 11, and the plug-in piece 122 can enter into the accommodating groove 111. The container 10 further includes a fixing piece 13, and the fixing piece 13 detachably covers the opening of the accommodating groove 111 and buckles the plug-in piece 122 accommodated in the accommodating groove 111. The specific working principle thereof is as follows.

When the cover 12 needs to be installed on the tank body 11, the plug-in piece 122 of the cover 12 is only needed to be inserted into the accommodating groove 111, the fixing piece 13 is buckled on the plug-in piece 122, then the fixing piece 13 is connected with the wall of the accommodating groove 111, and then the cover 12 is installed on the tank body 11. When the cover 12 needs to be detached, first the fixing piece 13 is detached from the wall of the accommodating groove 111, then the fixing piece 13 is pushed to move away from the plug-in pieces 122, the fixing piece 13 is led out of the accommodating groove 111, and then the cover 12 is pushed in the direction away from the tank body 11, such that the cover 12 can be separated from the tank body 11. In this embodiment, the fixing piece 13 is buckled with the plug-in piece 122, and the fixing piece 13 is further detachably covered at the opening of the accommodating groove 111 on the tank body 11, thereby improving the stability of connection.

It shall be noted that in the related art, the cover is buckled in the buckling hole at the edge of the water storage tank through a buckling element at the edge of the cover. As the strength of the edge of the water storage tank is low, when the cover is pressed, the edge of the water storage tank is greatly deformed under the action of the external force, such that the buckling element at the edge of the cover is not completely buckled into the buckling hole, and thus the cover will easily be detached from the water storage tank. As compared to the related art, in the container 10 of the embodiment of the present disclosure, the cover 12 includes the cover body 121 and the plug-in piece 122, the plug-in piece 122 can extends into the accommodating groove 111 on the tank body 11. The plug-in piece 122 is arranged in the accommodating groove 111, the fixing piece 13 is buckled with the plug-in piece 122, and the fixing piece 13 is further detachably covered at the opening of the accommodating groove 111 on the tank body 11, such that the plug-in piece 122 can be restricted in the accommodating groove 111, thereby improving the stability of connection, solving the technical problem that the cover is likely to fall off by being buckled into the buckling hole of the water storage tank, and improving the connection steadiness.

It shall be noted that in this embodiment, there are a plurality of plug-in pieces 122, a plurality of accommodating grooves 111, and a plurality of fixing pieces 13. The plurality of plug-in pieces 122 are arranged at intervals along the periphery of the cover body 121, thereby realizing the tight connection between the cover 12 and the tank body 11. The plurality of accommodating grooves 111 are arranged at intervals along the periphery of the tank body 11. Each of the fixing pieces 13 is detachably covered at the opening of a corresponding one of the accommodating grooves 111.

In one embodiment of the present disclosure, the cover 12 includes a handle 124, and the handle 124 is installed on the cover body 121. Further, the cover body 121 defines a passage 126, and the passage 126 runs all the way through two opposite sidewalls of the cover body 121. The handle 124 is arranged over the passage 126. The passage 126 allows the hand of a user to pass through to hold the handle 124.

In one embodiment of the present disclosure, referring to FIG. 3, a sidewall of the accommodating groove 111 defines a gap 1110, the sidewall of the accommodating groove 111 is provided thereon with a first buckle 112, and the sidewall of the fixing piece 13 is provided with a first buckling hole 131 at a position corresponding to the first buckle 112. During installation, the detachable connection between the sidewall of the accommodating groove 111 and the sidewall of the fixing piece 13 is simply realized by engaging the first buckle 112 on the sidewall of the accommodating groove 111 with the first buckling hole 131 on the sidewall of the fixing piece 13.

Of course, in other embodiments, the sidewall of the accommodating groove 111 may define a first buckling hole, and the sidewall of the fixing piece 13 may be provided with a first buckle at a position corresponding to the first buckling hole. During installation, the detachable connection between the sidewall of the accommodating groove 111 and the sidewall of the fixing piece 13 is simply realized by engaging the first buckle on the sidewall of the fixing piece 13 with the first buckling hole on the sidewall of the accommodating groove 111.

Figure 6:
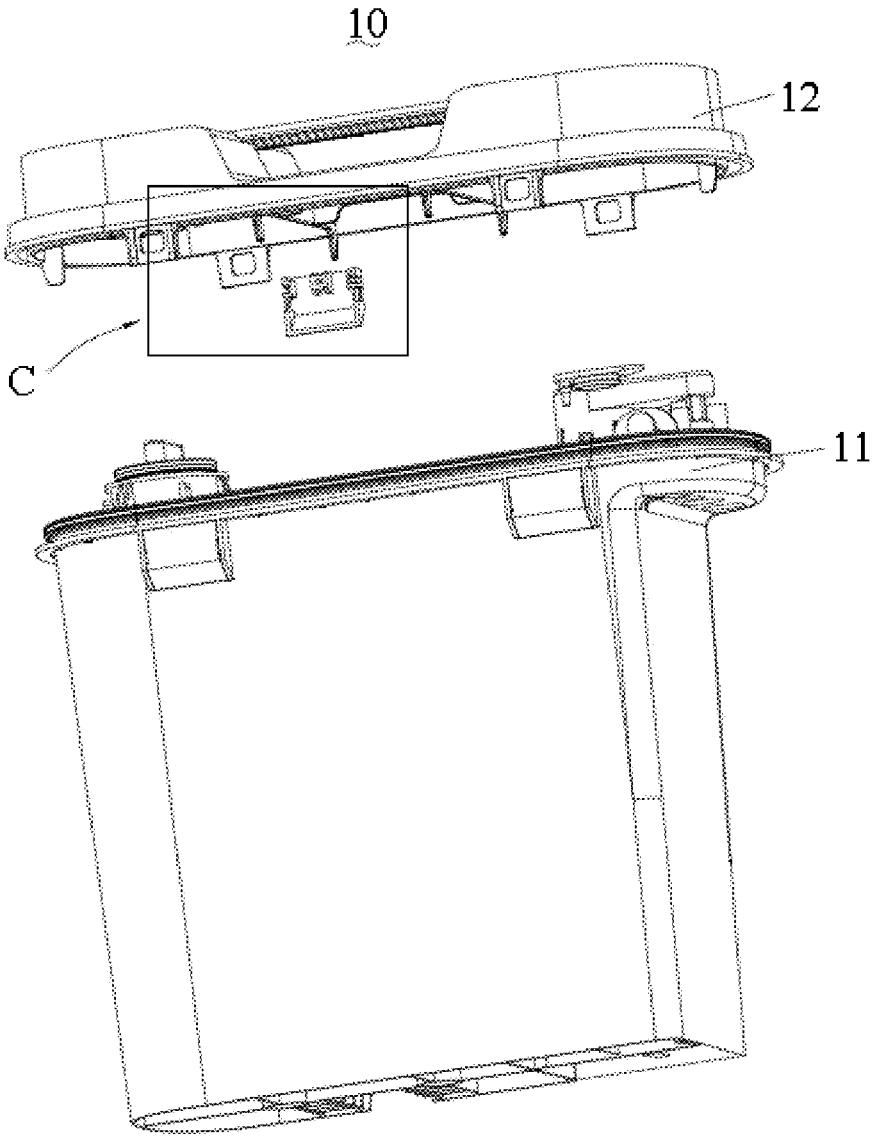
FIG. 6 is a third exploded schematic view of the container of FIG. 1.
Figure 7:
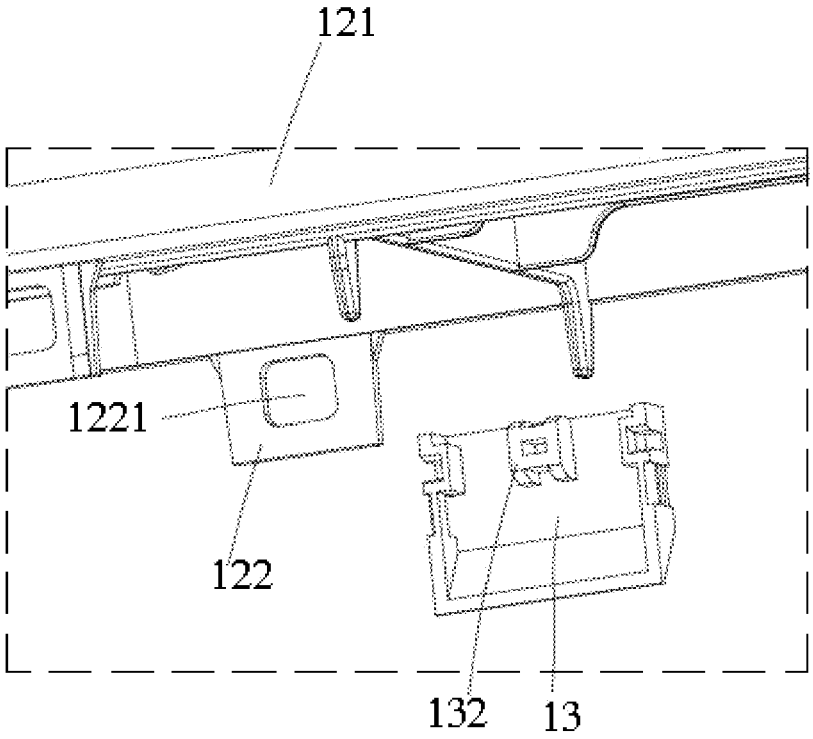
FIG. 7 is a partial enlarged schematic view of part C in FIG. 6.

Further, referring to FIG. 6 and FIG. 7, the plug-in piece 122 is provided thereon with a second buckling hole 1221, and the fixing piece 13 is provided with a second buckle 132 at a position corresponding to the second buckling hole 1221. During installation, the fixing piece 13 is buckled with the plug-in piece 122 simply by engaging the second buckle 132 of the fixing piece 13 with the second buckling hole 1221 of the plug-in piece 122, thereby enabling the second buckle 132 of the fixing piece 13 to be completely buckled into the second buckling hole 1221 of the plug-in piece 122.

Of course, in other embodiments, the sidewall of the plug-in piece 122 facing the fixing piece 13 is provided thereon with a second buckle, and the fixing piece 13 is provided thereon with a second buckling hole at a position corresponding to the second buckle. During installation, the fixing piece 13 is buckled with the plug-in piece 122 simply by engaging the second buckle on the plug-in piece 122 with the second buckling hole on the fixing piece 13.

Specifically, in this embodiment, first the fixing piece 13 is buckled onto the plug-in piece 122, and the gap 1110 is defined on the sidewall of the accommodating groove 111, such that it is convenient to squeeze the plug-in piece 122 by hands or tools. In this way, the second buckle 132 of the fixing piece 13 can be completely buckled into the second buckling hole 1221 of the plug-in piece 122 or the second buckle 132 of the plug-in piece 122 is completely buckled into the second buckling hole 1221 of the fixing piece 13, and the plug-in piece 122 can pull the fixing piece 13 to prevent the fixing piece 13 from falling off. Further, the fixing piece 13 is connected with the accommodating groove 111 by the engagement between the first buckle 112 and the first buckling hole 131, thereby restricting the shaking of the plug-in piece 122 and improving the connection stability.

Figure 9:
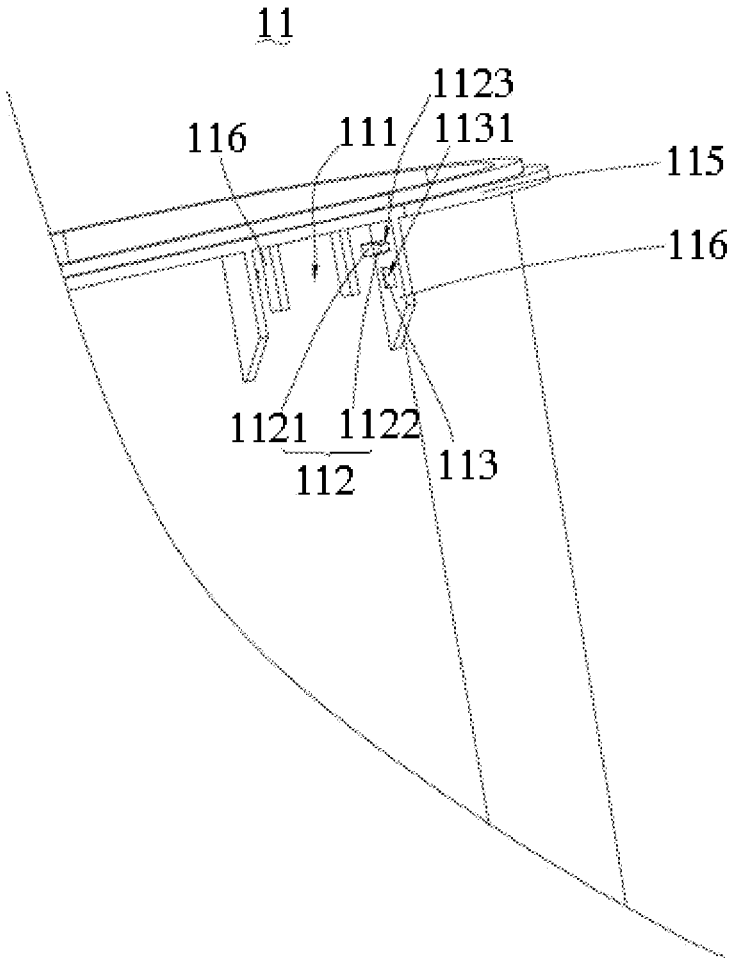
FIG. 9 is a first partial perspective schematic view of a tank body of the container of FIG. 1.

In one embodiment of the present disclosure, referring to FIG. 3 and FIG. 9, the first buckle 112 includes a first connecting section 1121 and a second connecting section 1122, and both of the first connecting section 1121 and the second connecting section 1122 are block-shaped structures. The first connecting section 1121 includes a fixed end and a free end, and the second connecting section 1122 extends from the free end of the first connecting section 1121 towards a side away from the fixed end of the first connecting section 1121. The second connecting section 1122 includes a first guiding surface 1123, and the first guiding surface 1123 is configured to guide the first buckle 112 to be buckled into the first buckling hole 131, such that it is convenient for the second connecting section 1122 to be engaged with the first buckling hole 131 after passing through the first buckling hole 131. By the arrangement of the first guiding surface 1123, the first buckle 112 and the first buckling hole 131 can undergo controllable elastic deformation according to the guidance when they are engaged, such that the first buckle 112 can be buckled into the first buckling hole 131 simply by being horizontally pushed with a slight external force and the buckling effect is better.

Specifically, in this embodiment, the fixed end of the first connecting section 1121 is arranged on the sidewall of the accommodating groove 111, and the first guiding surface 1123 of the second connecting section 1122 is an inclined surface which is convenient to be machined on the second connecting section 1122. That is, the first guiding surface 1123 can be machined on the second connecting section 1122 simply by cutting.

Of course, in other embodiments, the first guiding surface 1123 may be an arc-shaped surface, which may be selected according to specific requirements.

Figure 11:
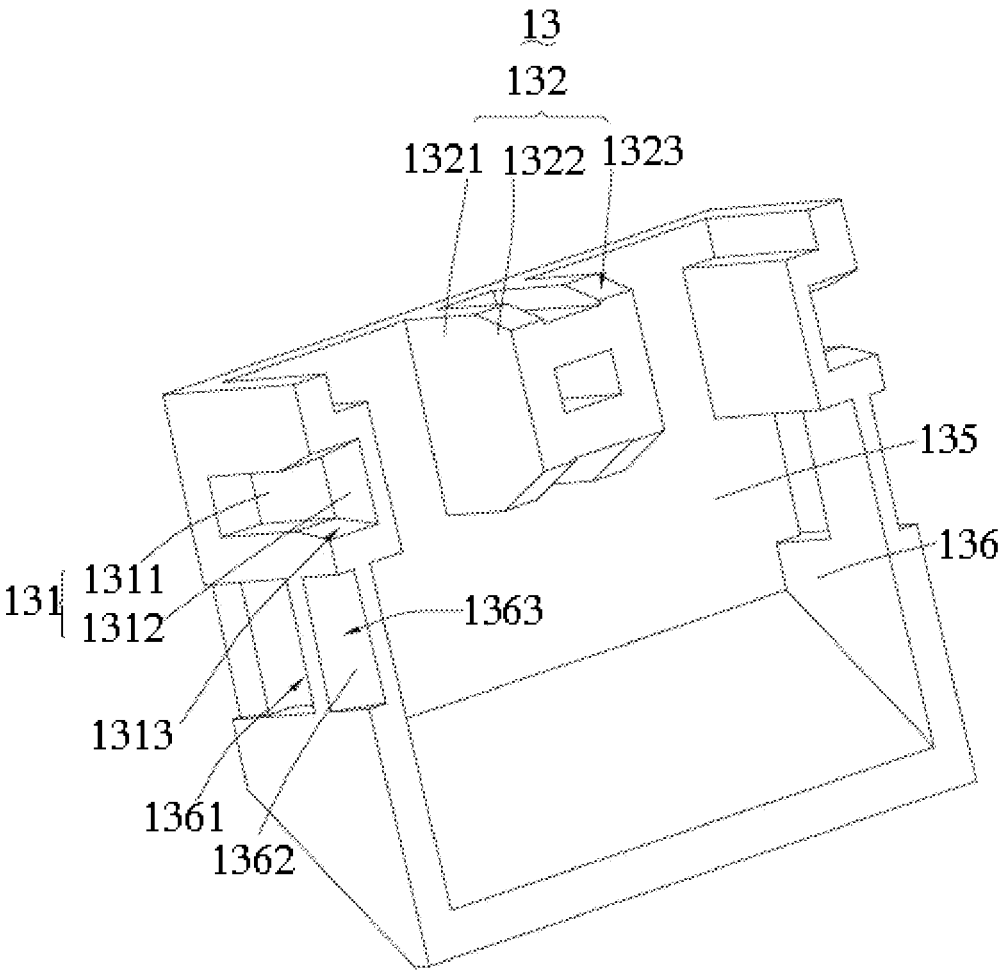
FIG. 11 is a partial perspective schematic view of a fixing piece of the container of FIG. 1.

Further, referring to FIG. 11, in order to facilitate engagement with the first buckle 112, the first buckling hole 131 includes a first hole section 1311 and a second hole section 1312, the first hole section 1311 is configured to accommodate the free end of the first connecting section 1121 and the second connecting section 1122, and the second hole section 1312 is in communication with one end of the first hole section 1311 for accommodating the fixed end of the first connecting section 1121. The sidewall of the second hole section 1312 is provided thereon with a second guiding surface 1313, and the second guiding surface 1313 is configured to engage with the first guiding surface 1123 for guiding. In this way, it is convenient for the second buckle 132 to be buckled into the first buckling hole 131, and the connection between the fixing piece 13 and the sidewall of the accommodating groove 111 is realized, that is, the connection between the fixing piece 13 and the tank body 11 is realized. The second guiding surface 1313 is also an inclined surface which is convenient to be machined, and the second guiding surface 1313 can be machined simply by cutting.

Of course, in other embodiments, the second guiding surface 1313 may be an arc-shaped surface, which may be selected according to specific requirements.

In one embodiment of the present disclosure, further referring to FIG. 11, the second buckle 132 includes a third connecting section 1321 and a fourth connecting section 1322, and both of the third connecting section 1321 and the fourth connecting section 1322 are square blocks. The third connecting section 1321 includes a fixed end and a free end, and the fourth connecting section 1322 extends from the free end of the third connecting section 1321 towards the side far away from the fixed end of the third connecting section 1321. The fourth connecting section 1322 includes a third guiding surface 1323, and the third guiding surface 1323 is configured to guide the second buckle 132 to be buckled into the second buckling hole 1221. By the arrangement of the third guiding surface 1323, the second buckle 132 and the second buckling hole 1221 can undergo controllable elastic deformation according to the guidance when they are engaged, such that the second buckle 132 can be buckled into the second buckling hole 1221 simply by being horizontally pushed with a slight external force and the buckling effect is better.

Figure 8:
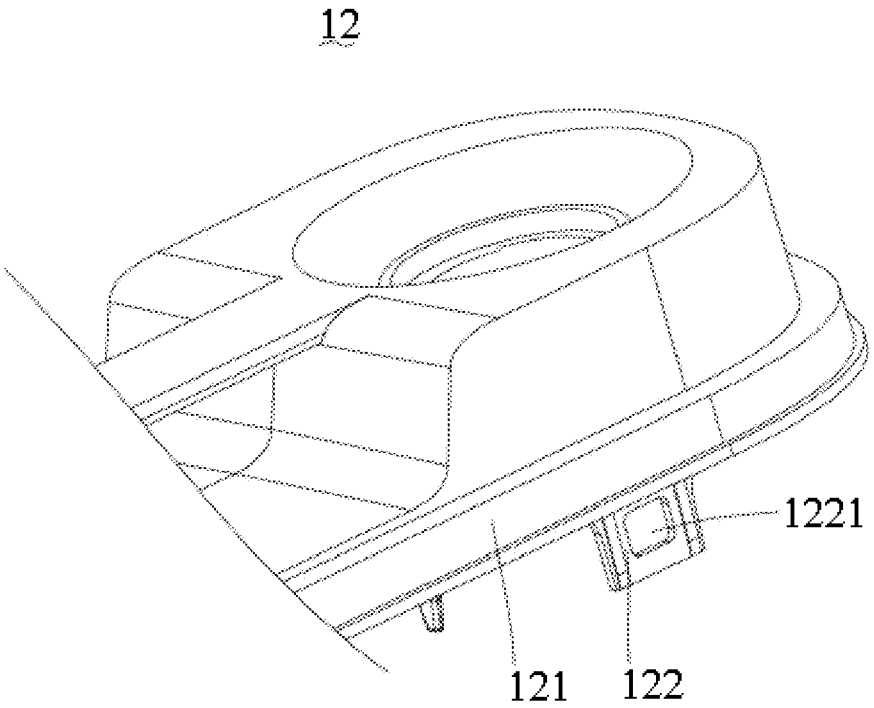
FIG. 8 is a partial perspective schematic view of a cover of the container of FIG. 1.

Further, referring to FIG. 8, the second buckling hole 1221 is a square hole, and the second buckling hole 1221 includes four connecting surfaces. At the mutual joint of two adjacent connecting surfaces, a cut corner or rounded corner is formed between two adjacent connecting surfaces, and the cut corner or rounded corner is configured to guide in cooperation with the third guiding surface 1323, thereby facilitating the second buckle 132 to be buckled into the second buckling hole 1221.

In one embodiment of the present disclosure, referring to FIG. 9 and FIG. 11, the sidewall of the accommodating groove 111 is further provided thereon with a third buckle 113, the fixing piece 13 includes a cover part 135 and an extension part 136, and the extension part 136 extends from the edge of the cover part 135 towards the side facing away from the cover part 135. The extension part 136 defines a fastening groove 1361 and a guiding groove 1362, and the fastening groove 1361 is configured to buckle with the third buckle 113. The guiding groove 1362 is arranged at one side of the extension part 136 facing the accommodating groove 111, and the guiding groove 1362 is configured to guide the third buckle 113 to slide into the fastening groove 1361. That is, the extension part 136 is pushed to deform inwards under the engagement of the guiding groove 1362 with the third buckle 113, such that the third buckle 113 passes through the guiding groove 1362 and then is buckled with the fastening groove 1361. The specific working principle thereof is as follows.

First, the fixing piece 13 is pushed to move toward the plug-in piece 122. When the extension part 136 of the fixing piece 13 moves to the third buckle 113, the guiding groove 1362 of the extension part 136 engages with the third buckle 113, and under the guidance of the guiding groove 1362, the extension part 136 is pushed to deform in the direction away from the third buckle 113, thereby facilitating the third buckle 113 to pass through the guiding groove 1362. After the third buckle 113 passes through the guiding groove 1362, the deformation of the extension part 136 is recovered, and the third buckle 113 is buckled in the fastening groove 1361, thereby facilitating the buckling of the third buckle 113 with the fastening groove 1361, further realizing the connection between the fixing piece 13 and the accommodating groove 111, and further improving the connection stability.

Specifically, in this embodiment, the third buckle 113 includes a fourth guiding surface 1131, and the fourth guiding surface 1131 is arranged on one side of the third buckle 113 facing the fixing piece 13. Correspondingly, the guiding groove 1362 includes a fifth guiding surface 1363 configured to engage with the fourth guiding surface 1131, and the fifth guiding surface 1363 is arranged at the bottom of the guiding groove 1362. Both the fourth guiding surface 1131 and the fifth guiding surface 1363 are inclined surfaces which are convenient to be machined.

It shall be noted that, after the fastening groove 1361 of the extension part 136 is buckled with the third buckle 113 of the sidewall of the accommodating groove 111, in order to prevent the third buckle 113 from shaking in the fastening groove 1361, the guiding groove 1362 and the fastening groove 1361 are isolated from each other, that is, they are not in communication with each other.

In one embodiment of the present disclosure, referring to FIG. 5, the container 10 further includes a supporting rib 14, and the supporting rib 14 is arranged on one side of the plug-in piece 122 facing the accommodating groove 111 and located on the bottom wall of the accommodating groove 111. The supporting rib 14 is configured to support the plug-in piece 122. By the arrangement of the supporting rib 14, the supporting rib 14 can provide a supporting function to a certain extent during the plug-in piece 122 is squeezed by the fixing piece 13. Thus, it facilitates the buckling between the fixing piece 13 and the plug-in piece 122 and prevents the plug-in piece 122 from being deformed and unable to be buckled with the fixing piece 13 when the plug-in piece 122 is squeezed by the fixing piece 13.

Specifically, further referring to FIG. 5, there are a plurality of supporting ribs 14, and in this embodiment, there are two of the supporting ribs 14, the two supporting ribs 14 are respectively arranged on both sides of the plug-in piece 122. It shall be noted that, when the plug-in piece 122 defines a buckling hole, the supporting ribs 14 need to avoid the position of the buckling hole and are misaligned with the buckling hole. Otherwise, when the buckle of the fixing piece 13 is buckled into the buckling hole, the supporting ribs 14 interfere with the buckle and affect the engagement between the buckle and the buckling hole, i.e., obstruct the buckle from being completely extended in the buckling hole.

Figure 10:
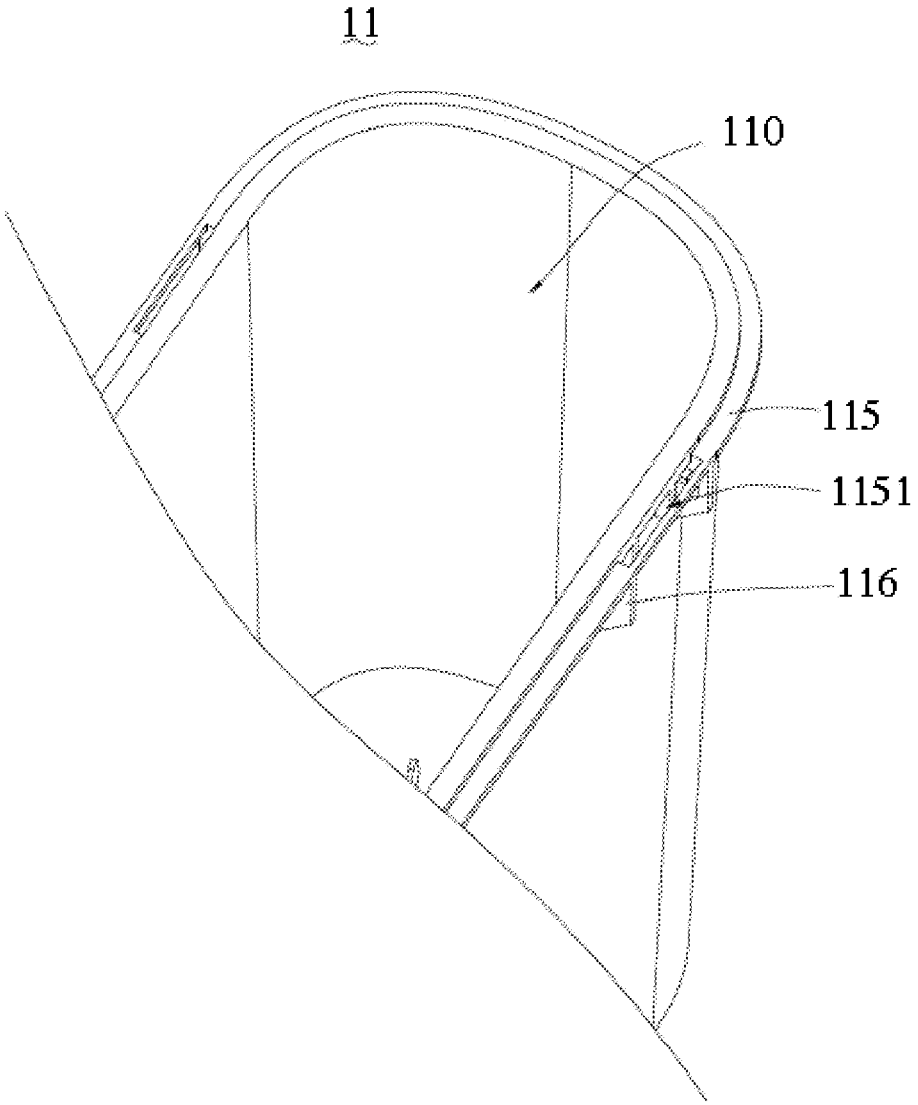
FIG. 10 is a second partial perspective schematic view of the tank body.

In one embodiment of the present disclosure, further referring to FIG. 9 and FIG. 10, the sidewall of the tank body 11 is further provided thereon with a flange 115, and the flange 115 is arranged around the opening 110 of the tank body 11. The flange 115 defines an insertion hole 1151 for the plug-in piece 122 to pass through, and the insertion hole 1151 is in communication with the accommodating groove 111. The insertion hole 1151 is defined on the flange 115 and is connected with the accommodating groove 111, it is convenient for the plug-in piece 122 of the cover 12 to pass through the insertion hole 1151 and then extend into the accommodating groove 111.

Specifically, in this embodiment, the sidewall of the tank body 11 is further provided thereon with two connecting ribs 116, and the two connecting ribs 116 are arranged opposite to each other. The end of each of the connecting ribs 116 is connected with the flange 115. The two connecting ribs 116, the flange 115 and the sidewall of the tank body 11 cooperatively define the accommodating groove 111. Since the connecting ribs 116 are exposed on the sidewall of the tank body 11, it is convenient to disassemble the fixing piece 13 from the connecting ribs 116, such that the fixing piece 13 is disconnected from the connecting ribs 116.

Figure 12:
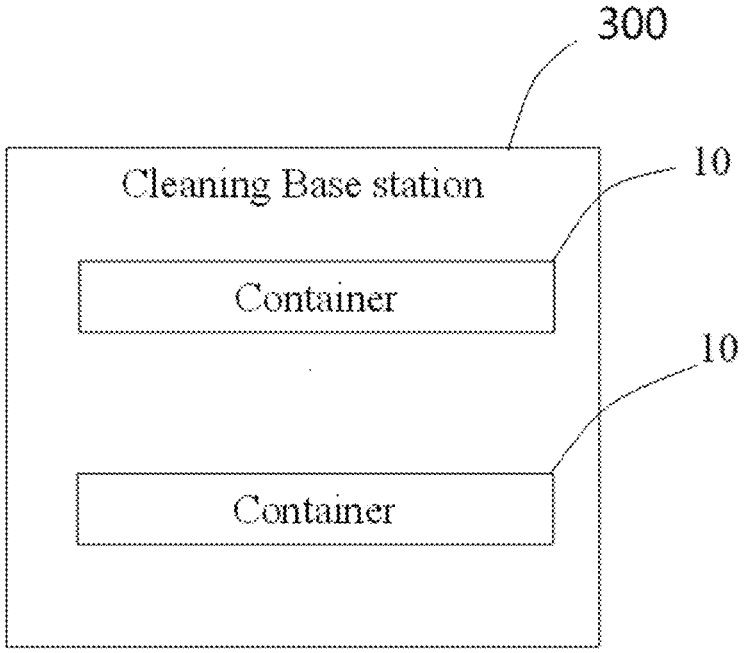
FIG. 12 is a functional block view of a cleaning base station according to another embodiment of the present disclosure.

Referring to FIG. 12, another embodiment of the present disclosure further provides a cleaning base station 300, and the cleaning base station 300 includes at least two of the containers 10 in any of the above embodiments.

The cleaning base station 300 provided according to the embodiment of the present disclosure adopts the container 10 described above. The cover 12 includes the cover body 121 and the plug-in piece 122, the plug-in piece 122 passes through the top wall of the accommodating groove 111 of the tank body 11, the plug-in pieces 122 are arranged in the accommodating groove 111, such that the fixing piece 13 is buckled with the plug-in piece 122. Then, the fixing piece 13 is further detachably connected with the sidewall of the accommodating groove 111 of the tank body 11, such that the plug-in piece 122 can be restricted in the accommodating groove 111. In this way, the stability of connection is improved, the technical problem in the prior art that the cover 12 is likely to fall off by being buckled into the buckling hole of the water storage tank is solved, and the connection steadiness is high.

Specifically, in this embodiment, there are two containers 10, wherein the tank body 11 in one container 10 is configured to contain cleaning solution, and the tank body 11 in the other container 10 is configured to contain sewage.

What described above are only some embodiments of the present disclosure and are not intended to limit the present disclosure. Any modifications, equivalent substitutions and improvements or the like made within the spirit and principle of the present disclosure shall all be included within the protective scope claimed in the present disclosure.

What is claimed is:

1. A container for a cleaning base station, comprising a tank body and a cover, the tank body defining an opening, the cover detachably covering the opening of the tank body, a sidewall of the tank body defining an accommodating groove, the cover comprising a cover body and a plug-in piece extending from the cover body to the tank body, the plug-in piece being capable of extending into the accommodating groove; the container further comprising:

a fixing piece, detachably covering an opening of the accommodating groove and capable of fastening the plug-in piece in the accommodating groove;

wherein one of the plug-in piece and the fixing piece defines a second buckling hole, and the other one of the plug-in piece and the fixing piece comprises a second buckle at a position corresponding to the second buckling hole;

the second buckle comprises:

a third connecting section, comprising a fixed end and a free end; and a fourth connecting section, extending from the free end of the third connecting section to a side far away from the fixed end of the third connecting section, the fourth connecting section comprises a third guiding surface, and the third guiding surface is configured to guide the second buckle to be buckled into the second buckling hole;

each of the third connecting section and the fourth connecting section has a square cross-section, and the second buckling hole is a square hole.

2. The container of claim 1, wherein the accommodating groove comprises a first buckle, the first buckle is positioned on a sidewall of the accommodating groove, and a sidewall of the fixing piece defines a first buckling hole at a position corresponding to the first buckle.

3. The container of claim 2, wherein the first buckle comprises:

a first connecting section, the first connecting section comprising a fixed end and a free end; and a second connecting section, extending from the free end of the first connecting section to a side far away from the fixed end of the first connecting section, and the second connecting section comprises a first guiding surface, the first guiding surface is configured to guide the first buckle to be buckled into the first buckling hole.

4. The container of claim 3, wherein the first buckling hole comprises:

a first hole section, configured to accommodate the free end of the first connecting section and the second connecting section; and a second hole section, being in communication with the first hole section and being configured to accommodate the fixed end of the first connecting section; a sidewall of the second hole section is formed with a second guiding surface, and the second guiding surface is configured to engage with the first guiding surface.

5. The container of claim 1, wherein the second buckling hole comprises four connecting surfaces; at a mutual joint of two adjacent connecting surfaces, a cut corner or rounded corner is formed between two adjacent connecting surfaces.

6. A container for a cleaning base station, comprising a tank body and a cover, the tank body defining an opening, the cover detachably covering the opening of the tank body, a sidewall of the tank body defining an accommodating groove, the cover comprising a cover body and a plug-in piece extending from the cover body to the tank body, the plug-in piece being capable of extending into the accommodating groove; the container further comprising:

a fixing piece, detachably covering an opening of the accommodating groove and capable of fastening the plug-in piece in the accommodating groove;

wherein the accommodating groove comprises a third buckle, the third buckle is positioned on a sidewall of the accommodating groove;

the fixing piece comprises:

a cover part; and an extension part, extending from an edge of the cover part to a side facing away from the cover part, the extension part defines a fastening groove and a guiding groove, the guiding groove and the fastening groove are partitioned from each other, the fastening groove is configured to buckle with the third buckle, and the guiding groove is configured to guide the third buckle to slide into the fastening groove.

7. The container of claim 6, wherein the third buckle comprises a fourth guiding surface, the guiding groove comprises a fifth guiding surface, and the fifth guiding surface is configured to engage with the fourth guiding surface.

8. The container of claim 1, wherein the tank body comprises a plurality of supporting ribs and the supporting ribs are located on a bottom wall of the accommodating groove and are configured to support the plug-in piece.

9. The container of claim 8, wherein the plurality of supporting ribs comprises two supporting ribs; and the plug-in piece defines a second buckling hole, and the fixing piece comprises a second buckle at a position corresponding to the second buckling hole;

when the plug-in piece is inserted into the accommodating groove and the second buckle is buckled into the second buckling hole, the two supporting ribs are positioned on two opposite sides of the plug-in piece and misaligned with the second buckling hole.

10. The container of claim 1, wherein the tank body comprises a flange, the flange is positioned on the sidewall of the tank body, the flange is arranged around the opening of the tank body, the flange defines an insertion hole configured to allow the plug-in piece to pass through, and the insertion hole is in communication with the accommodating groove.

11. The container of claim 10, wherein the tank body comprises two connecting ribs, the two connecting ribs are positioned on the sidewall of the tank body and are arranged opposite to each other, an end of each of the two connecting ribs is connected with the flange, and the two connecting ribs, the flange and the sidewall of the tank body cooperatively define the accommodating groove.

12. The container of claim 1, wherein the cover comprises a handle, and the handle is installed on the cover body.

13. The container of claim 12, wherein the cover body defines a passage, and the handle is arranged over the passage.

14. The container of claim 13, wherein the passage runs all the way through two opposite sidewalls of the cover body.

15. The container of claim 1, wherein a sidewall of the accommodating groove defines a gap.

16. A cleaning base station, comprising at least two containers of claim 1.

17. The container of claim 1, wherein the fixing piece comprises a first buckle, the first buckle is positioned on a sidewall of the fixing piece, and a sidewall of the accommodating groove defines a first buckling hole at a position corresponding to the first buckle.

18. The container of claim 17, wherein the first buckle comprises:

a first connecting section, the first connecting section comprising a fixed end and a free end; and a second connecting section, extending from the free end of the first connecting section to a side far away from the fixed end of the first connecting section, and the second connecting section comprises a first guiding surface, the first guiding surface is configured to guide the first buckle to be buckled into the first buckling hole.

19. The container of claim 18, wherein the first buckling hole comprises:

a first hole section, configured to accommodate the free end of the first connecting section and the second connecting section; and a second hole section, being in communication with the first hole section and being configured to accommodate the fixed end of the first connecting section; a sidewall of the second hole section is formed with a second guiding surface, and the second guiding surface is configured to engage with the first guiding surface.

* * * * *